United States Patent [19]

Burton et al.

[11] 4,143,855

[45] Mar. 13, 1979

[54] WINCH

[75] Inventors: John D. Burton, Catherington; Richard D. J. Huggett, Horndean, both of England

[73] Assignee: Lewmar Marine Limited, Hampshire, England

[21] Appl. No.: 797,251

[22] Filed: May 16, 1977

[30] Foreign Application Priority Data

Sep. 8, 1976 [GB] United Kingdom ..... 37280/76

[51] Int. Cl.[2] ..... B66D 1/30

[52] U.S. Cl. ..... 254/150 R; 24/132 R

[58] Field of Search ..... 254/150 R, 138, 175.7, 254/186 HC, 190 R, 175.5; 114/218; 74/812; 24/132 R, 115 R

[56] References Cited

U.S. PATENT DOCUMENTS

| | | | |
|---|---|---|---|
| 1,893,723 | 1/1933 | Wood | 254/150 R |
| 2,793,740 | 5/1957 | Dawdt | 254/150 R |
| 3,120,043 | 2/1964 | Henley | 24/132 |
| 3,656,596 | 4/1972 | Morgan | 254/150 R |
| 3,985,340 | 10/1976 | Guangorena | 254/150 R |

*Primary Examiner*—Trygve M. Blix
*Assistant Examiner*—Kenneth W. Noland
*Attorney, Agent, or Firm*—Cushman, Darby & Cushman

[57] ABSTRACT

A self tailing winch has a tailing channel defined by a pair of jaws one of which rotates with the drum of the winch but one of which is non-rotatable. A line guide and stripper element are associated with the non-rotatable jaw, preferably being integrally formed with it, in one piece.

10 Claims, 5 Drawing Figures

Fig. 3
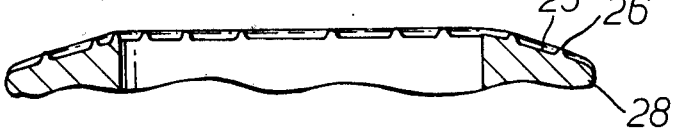
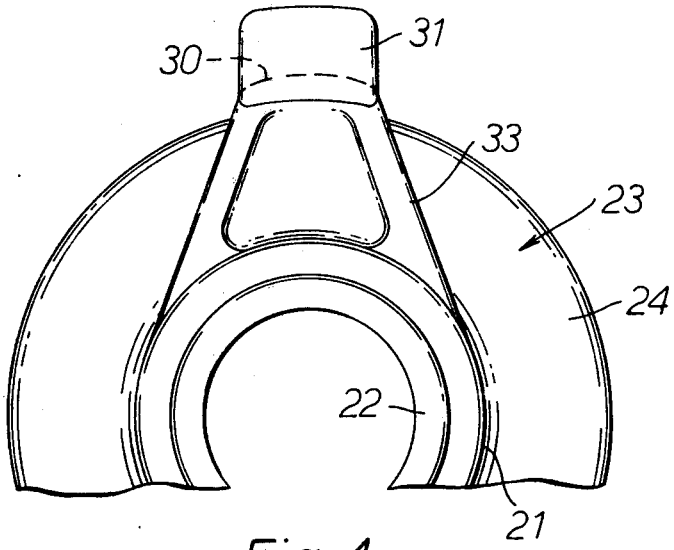
Fig. 4
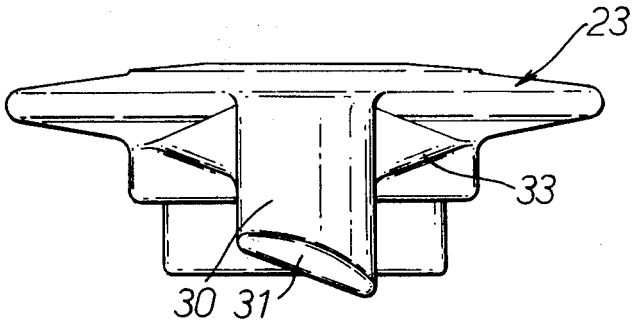
Fig. 5

WINCH

FIELD OF THE INVENTION

This invention relates to a manually powdered winch which is self-tailing. This means that the winch does not require the operator to carefully assemble a plurality of turns of line around the drum and then to maintain contact while operation of the winch builds up tension in the line being pulled; rather, the operator may place the line more or less loosely on the drum, fit it into a part of the winch specially adapted for tailing and, more or less carefully, wind the winch whereupon tension will be applied to the line by means of the drum of the winch.

BACKGROUND OF THE INVENTION

Much attention has centered in this type of winch in providing additional jaws at one axial end of the winding drum of the winch and which have acted as gripping jaws which compress the line axially between them and hold it at a time before the line has become tensioned and properly wound onto the drum of the winch. Examples are U.S. Pat. Nos. 3,730,483 of Newell and 3,968,953 of Guangorena.

These jaws have always been driven to rotate with the drum by positive linkages between themselves and the drive mechanism which drives the drum, or by being integral with the drum. The reason for this is obvious — if the self tailing device is going to draw a line properly onto the drum then it must necessarily move with the drum. In contrast, in devices which are for tautening line and which are more properly called cleats (an example is U.S. Pat. No. 3,120,043 of Henley) line was taken between a serrated unidirectionally rotating plate and a serrated fixed plate. Unidirectional rotation of the one plate would draw line in one direction while the stationary nature of the other plate prevented the line running back when driving was stopped. This idea is clearly inapplicable to winches where continuous forward and progressive motion of the sheet is desired, and where eventual loads will require multiple turns of the line around the winch drum.

SUMMARY OF THE INVENTION

It is therefore a most surprising development, and one which cuts across all the ideas which have become accepted concerning self tailing winches, that in the present invention we are proposing the provision of a self tailing device in a winch which includes a pair of annular jaw elements defining a channel in which a rope is to be received, one of which is caused to rotate with the drum of the winch (and is preferably integral with one end plate of the drum), this one jaw having means for exerting a tangential grip on a rope in contact with it, whereas the other jaw, which is tangentially smooth, is stationary and fixed to a stationary support frame of the winch. The two jaws may be axially fixed relative to each other or may be axially relatively movable and resiliently urged towards each other. Axially fixed jaws, mutually adjacent surface of which converge towards each other gradually in the radially inward direction are quite effective over a certain range of rope sizes; as is generally known, the provision of axially sprung plates increases somewhat the range of rope sizes which may be accommodated.

The non-rotating jaw may have formed integrally with it a cylindrical and stationary surface defining an innermost surface of the channel formed between the jaws and also have integrally formed with it a line guide for guiding line into the channel and a line stripper for causing line to be removed from it after it has followed nearly 360° of travel round that channel.

The present invention is applicable in principle to winches of any size and of any number of speed ratios.

DESCRIPTION OF THE DRAWINGS

A particular embodiment will be described with reference to the accompanying drawing wherein:

FIG. 3 is a section on the line X-Y, FIG. 2,

FIG. 4 is an underneath plan face view of the upper jaw, and

FIG. 5 is a side view of the upper jaw and guide arm.

DESCRIPTION OF A PREFERRED EMBODIMENT

Figure 1:
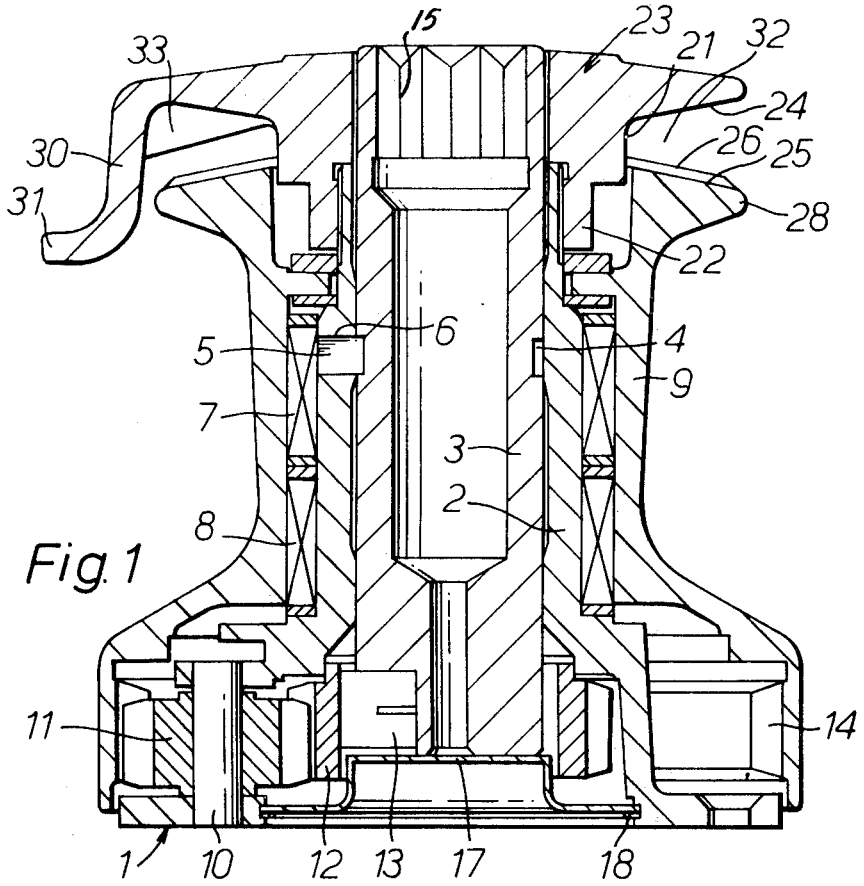
FIG. 1 is a diametrical section through the embodiment.
Figure 2:
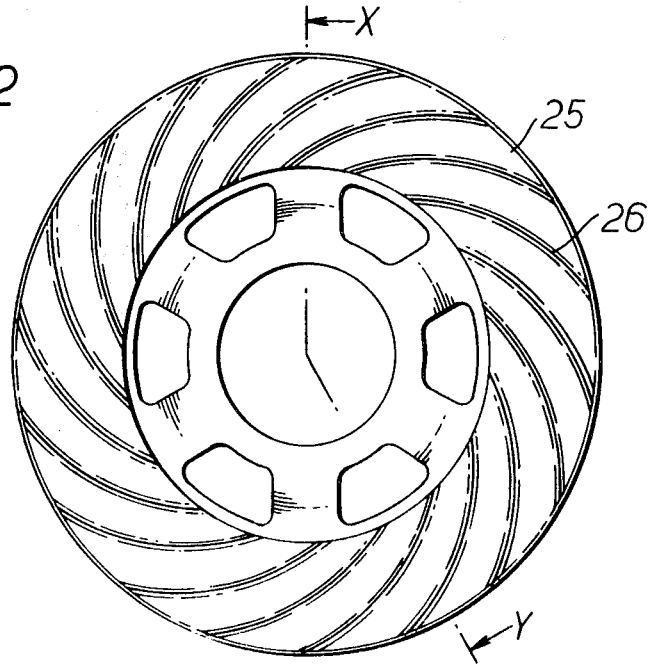
FIG. 2 is a plan face view of the lower jaw of the self-tailing device.

The winch shown in FIG. 1 is a single-speed geared winch. It has a base plate 1 which is for securing to the deck of a yacht or the like. From this base plate 1 rises a cylindrical sleeve 2 within which is rotatable a central drive spindle 3. The central drive spindle 3 is grooved at 4 and is held axially in position by a key 5 received through a window 6 in the cylindrical sleeve and held in position by having slid over it an inner race of rolling bearings 7,8 supporting the rotatable drum 9 of the winch.

On the base plate 1 and integrally with it are provided journals for a shaft 10 for gear 11. The gear 11 transmits drive from a gear 12 mounted, with the interposition of a pawl and ratchet unidirectional drive 13, on the base of the drive shaft 10, to an internal gear ring 14 at the internal lower edge of the drum 9. Also mounted on the base plate 1 is a non-return ratchet (not shown) acting on the teeth of gear 11 to prevent run-back of the drum. This assembly is held in position and protected by a dished base pressing 17 secured by circlip 18.

At the top of the cylindrical sleeve 2 is provided an externally screw-threaded portion 20 onto which is screw-threaded a lower sleeve part 22 of an integral casting 23 which provides at its upper end a plate 27 of which the lower annular surface acts as a jaw 24 which converges, radially inwardly, towards an annular jaw 25 which is integrally formed with and is the reverse surface of an end plate 28 of the winding surface 29 of that drum 9.

At one radius of the casting 23 there is provided an integral downturned arm 30 of which an integral outturned, slanted, channel shaped end acts as a line guide 31 for line being taken from the winding drum 9 into the channel 32 formed between the jaws 24,25 and to which there extends also divergent integral struts, an edge 33 of one of which acts as a stripper tongue. This removes in a manner known per se in this art, line from the channel 32 once it has followed almost 360° around it.

The jaw 25 is provided with spaced arcuate ribs 26 which are shaped to be on radii R from centres C eccentric of the axis A of the drum. Ribs shaped thus exert strong tangential resistance against movement of the line tangentially past them; and a slight but only slight radially inward component on that line when tension isexerted on the rope by the traction which is to be exerted by the rotating jaw 25. The fixed jaw 24 and the sleeve part 22 which defines the stationary base 21 of the channel are completely smooth.

In operation, the winch is used as self-tailing winches are in standard practice. One or two turns of line are taken loosely around the drum and the line is then taken to the line guide 31 and placed comparatively loosely in the channel 32. When the winch drum is turned, (a handle, not shown, being fitted into a polygonal blind bore 15 in the head of the spindle 3 for this purpose), traction is exerted on the line by virtue of the shaped ribs 26 on the rotating jaw 25. The slight radially inward component exerted by those ribs causes, in turn, axial compression of the line onto those ribs because of the radially inward convergence of the two jaws 24,25. This increases the positiveness with which the rotating jaw 25 draws the line onto the winch drum 9 which once there is tension in the line becomes effective in its own right for the exertion of traction on the line. It is found most surprisingly that the fact that the upper jaw is not rotating is completely immaterial to the efficient functioning of this self-tailing winch. The fact that this jaw is non-rotating greatly simplifies the construction of such winches and, most importantly, makes it possible to form the line guide and stripper element integrally with the upper jaw.

We claim:

1. In a self tailing winch having two jaws defining a self-tailing channel adjacent a rotatable winch drum, stationary means for guiding a line from said drum to said channel, and a stationary stripper tongue projecting into said channel to strip the line therefrom, the improvement comprising means for constraining one of said jaws to be stationary and means for constraining the other of the jaws to rotate with the winch drum.

2. The improvement as claimed in claim 1 wherein the said one jaw has a smooth annular surface defining one side of the channel, the one jaw being remoter from the winch drum than the other jaw.

3. The improvement as claimed in claim 2 wherein the other jaw has an annular surface defining a side of the channel opposite the one side, and ridges on the said annular surface for exerting a strong tangential resistance against movement of line in contact with them and a slight radially inwardly directed force on the said line.

4. A marine winch comprising:

a stationary winch structure;

a winch drum for receiving line therearound;

means mounting said winch drum on said winch structure for rotation about an axis;

self-tailing means on said winch;

stationary means for guiding line from said drum to said self-tailing means;

a stationary stripper tongue means for stripping line from said self-tailing means;

the self-tailing means comprising:

a first annular jaw and a second annular jaw;

the said jaws defining between them a channel for the reception of line from the winch drum, the channel having a base at its radially innermost zone;

means mounting the jaws coaxially with the axis of rotation of the drum;

the means mounting the first said jaw securing it to the stationary winch structure to restrain the jaw against rotation;

the means mounting the second said jaw constraining it to rotate with the said drum; and means for driving the drum and second jaw in rotation.

5. A marine winch as claimed in claim 4 wherein said self tailing means additionally comprises a line guide means comprising a channel member extending generally tangentially of the axis of rotation a support arm fast with the said first jaw and extending from it generally parallel to the axis of rotation to bridge across the said channel the line guide means being fast with the support arm and positioned radially outside it away from the axis of rotation and a stripper tongue, the stripper tongue being fast with the support arm and extending into the channel to adjacent the base thereof.

6. A marine winch as claimed in claim 5 wherein the side of the channel defined by the first annular jaw is smooth, the said second annular jaw defining the side of the channel axially closer to the winch drum and the said first annular jaw defining the side of the channel remoter from the winch drum.

7. A marine winch as claimed in claim 6 wherein all of the first jaw, channel base, support arm, line guide and stripper tongue are one-piece integral whole, and wherein the second jaw and the winch drum are a one-piece integral whole.

8. A marine winch as claimed in claim 5 wherein all of the first jaw, channel base, support arm, line guide and stripper tongue are a one-piece integral whole, the stripper tongue extending from the support arm to the first jaw.

9. A marine winch as claimed in claim 4 wherein the side of the channel defined by the first annular jaw is smooth.

10. A marine winch as claimed in claim 4 wherein the stationary winch structure includes a hollow cylindrical sleeve the means for driving the drum in rotation includes a central rotatable drive shaft a circumferential groove in the drive shaft a window in said sleeve in register with said groove a key housed in said window and engaged in said groove to restrain the shaft from axial movement the means for mounting the drum for rotation including rolling-contact bearing means the rolling contact bearing means surrounding said sleeve and constraining said key against radially outward movement away from the shaft.

* * * * *